US012012260B2

(12) United States Patent
Hwang

(10) Patent No.: US 12,012,260 B2
(45) Date of Patent: Jun. 18, 2024

(54) CHILD-RESISTANT CONTAINERS HAVING EMBEDDED COMPRESSION REGION

(71) Applicant: Greenlane Holdings, LLC, Boca Raton, FL (US)

(72) Inventor: Steve Hwang, Cypress, CA (US)

( * ) Notice: Subject to any disclaimer, the term of this patent is extended or adjusted under 35 U.S.C. 154(b) by 0 days.

(21) Appl. No.: 18/158,977

(22) Filed: Jan. 24, 2023

(65) Prior Publication Data

US 2023/0174276 A1 Jun. 8, 2023

Related U.S. Application Data

(63) Continuation of application No. 17/305,011, filed on Jun. 29, 2021, now Pat. No. 11,591,143, which is a continuation of application No. 16/517,376, filed on Jul. 19, 2019, now Pat. No. 11,046,486.

(60) Provisional application No. 62/819,169, filed on Mar. 15, 2019, provisional application No. 62/819,283, filed on Mar. 15, 2019, provisional application No. 62/776,881, filed on Dec. 7, 2018.

(51) Int. Cl.
*B65D 50/04* (2006.01)

(52) U.S. Cl.
CPC ..... *B65D 50/04* (2013.01)

(58) Field of Classification Search
CPC .... B65D 41/04; B65D 41/0471; B65D 41/06; B65D 50/02; B65D 50/04; B65D 50/045
See application file for complete search history.

(56) References Cited

U.S. PATENT DOCUMENTS 3,339,770 A * 9/1967 Weigand ..... B65D 41/06 215/214
3,659,735 A * 5/1972 Landen ..... B65D 41/06 215/222
6,398,051 B1 * 6/2002 Brozell ..... B65D 51/26 206/828

* cited by examiner

*Primary Examiner* — Andrew T Kirsch

(57) ABSTRACT

Various embodiments of containers are described having child-resistant closures. The containers can include a body having at least one wall that at least partially defines a hollow interior portion into which goods or other products can be stored. A wall of at least one of the body and cap can include a set of apertures that collectively define a compression region, which acts a living spring to allow compression of the wall to permit seating of lugs or other projection within notches.

13 Claims, 7 Drawing Sheets

CHILD-RESISTANT CONTAINERS HAVING EMBEDDED COMPRESSION REGION

This application is a divisional application of U.S. non-provisional application having Ser. No. 17/305,011 filed on Jun. 29, 2021, which itself is a continuation application of U.S. non-provisional application having Ser. No. 16/517,376 filed on Jul. 19, 2019 (now U.S. Pat. No. 11,046,486), which itself claims priority to U.S. provisional application having Ser. No. 62/776,881 filed on Dec. 7, 2018, U.S. provisional application having Ser. No. 62/819,283 filed on Mar. 15, 2019, and U.S. provisional application having Ser. No. 62/819,169 filed on Mar. 15, 2019. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is containers, and in particular, containers that are child-resistant.

BACKGROUND

The following description includes information that may be useful in understanding the present invention. It is not an admission that any of the information provided herein is prior art or relevant to the presently claimed invention, or that any publication specifically or implicitly referenced is prior art.

Child-resistant containers must meet certain regulatory guidelines. Traditional child resistance containers such as a medication bottle have a push down and turn style cap, where the container and cap are all made of plastic and a foam layer is utilized to create the child-resistant closure. U.S. Patent Publication number 2008/0223811 to Miceli et al. describes an exemplary embodiment of prior art child-resistant containers. However, such containers are often utilitarian in design, and have a number of components that must be manufactured and assembled to create the child-resistant container. In addition, some of the containers may not meet laws and regulations that have changed since they were first developed.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved child-resistance containers that eliminate the need for foam or other material to create the child-resistant closure.

SUMMARY OF THE INVENTION

The inventive subject matter provides apparatus, systems and methods for containers comprising a body having a base with at least one wall extending from the base. The base and at least one wall collectively define an interior portion of the body that has a first opening opposite of the base. Preferably, the interior portion is at least partially hollow. In the case of a cylindrical body, the body may comprise a base with a single sidewall having a circular cross-section extending from the base.

In certain embodiments, the body comprises an elongated tube whose height is greater than a diameter of a width of the body.

Contemplated containers further include a cap that engages with the body to thereby secure the cap to the body. It is preferred that at least one of the cap and body, and preferably the wall of the body, comprises a set of notches disposed on an exterior surface of the cap or body. In such embodiments, it is contemplated that the cap can comprise a set of lugs or projections disposed on an interior surface of the cap, wherein each of the lugs or projections is configured to be received within one of the notches. Preferably, each of the notches acts as a latch to receive a lug or projection, and there is a space disposed between adjacent latches which permit the lug or projection to pass by at least a portion of the latch.

Where the cap comprises the set of notches disposed on an interior surface of the cap, it is contemplated that the wall or other portion of the body comprises a set of lugs or projections disposed on its exterior surface, wherein each of the lugs or projections is configured to be received within one of the notches of the cap. As described above, each of the notches acts as a latch to receive the lug or projection, and a space is disposed between adjacent latches which permits each lug or projection to pass by at least a portion of the latch before being received in the notch.

It is especially preferred that the wall of the body or the cap comprises a plurality of cutouts or apertures in an upper portion of the wall or cap (e.g., away from the closed end), and in some embodiments, near or at a top surface. The plurality of cutouts or apertures collectively defines a compression region or living spring. In especially preferred embodiments, the cutouts have a curved shape, which may resemble a spiral, a semi-circle, a diamond or rounded triangle, for example.

To secure the cap to the body, the plurality of lugs or projections should be each inserted into one notch of the set of notches. This is accomplished by pushing the cap against the body, which thereby compresses the compression region and modifies a shape or dimension of one or more of the plurality of cutouts or apertures from an initial configuration to a compressed configuration. The cap can then be rotated with respect to the body, which causes the lugs or projections to be disposed at the notches. When the cap is no longer pushed against the body, the plurality of cutouts return to the initial position, which causes each of the lugs or projections to be seated within one of the notches.

In certain embodiments, it is contemplated that the upper portion of the wall or cap comprises a non-planar top surface having a set of peaks and valleys disposed between adjacent peaks. In such embodiments, the upper portion may further comprise a set of raised portions, each disposed between adjacent valleys and that define an upper surface of an aperture, and wherein the upper portion further comprises a set of apertures, each of which is at least partially disposed one of the peaks, and wherein a valley defines a space between two adjacent apertures. When a force is applied to the upper portion of the wall or cap, the raised portions compress and move from (i) an initial position and (ii) into the aperture disposed below the raised portion, and (ii) when the downward force is removed, the raised portions return to the initial position.

Thus, it is contemplated that the cap could include the compression region, and the cap could comprise a set of notches with the body comprising a set of lugs, or the cap could comprise a set of lugs where the body comprises a set of notches. It is further contemplates that the body or sidewall could comprise the compression region as described above, and the cap could comprise a set of notches with the body comprising a set of lugs, or the cap could comprise a set of lugs where the body comprises a set of notches.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
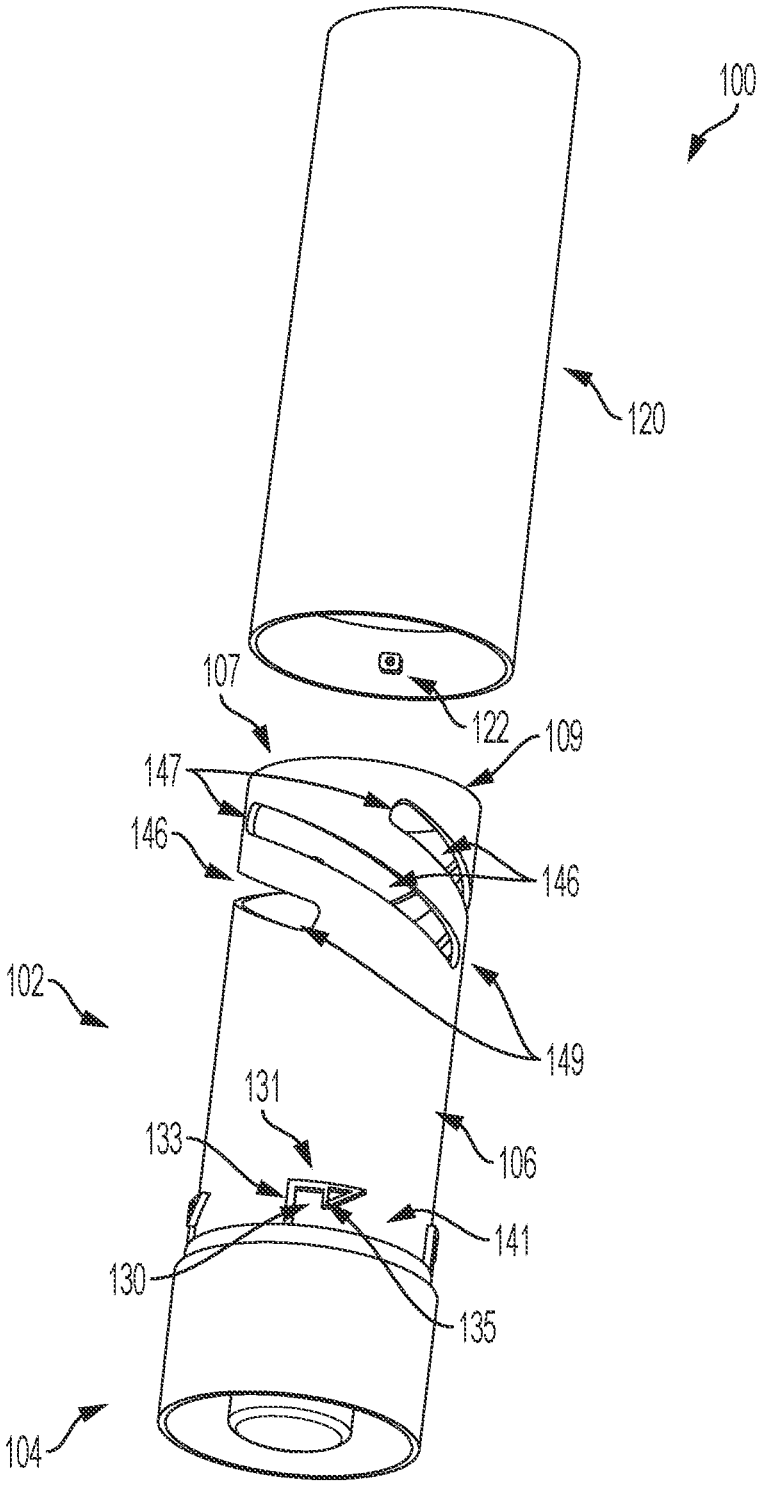
FIG. 1 illustrates an exploded view of one embodiment of a container.
Figure 2:
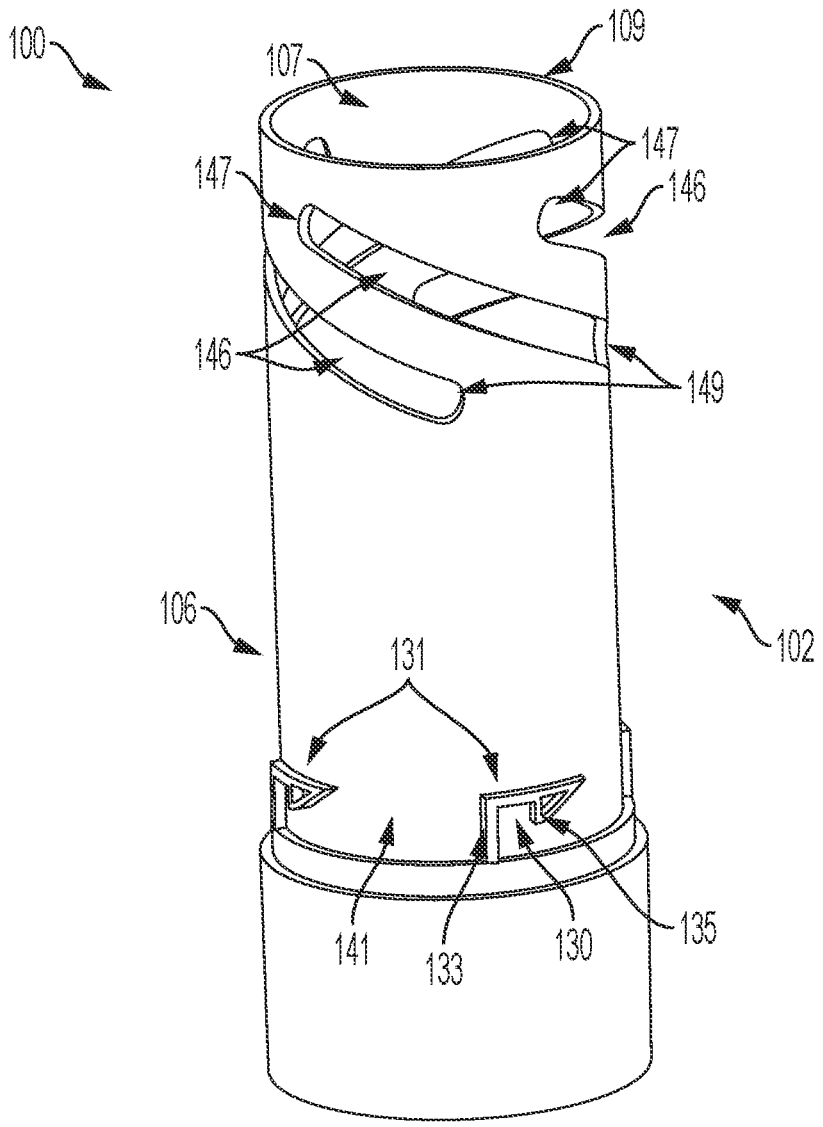
FIG. 2 illustrates a side view of the container of FIG. 1.

FIGS. 1-2 illustrate one embodiment of a container 100 comprising a body 102 having a base 104 with at least one sidewall 106 extending from the base 104, such that a portion of the base 104 and the at least one sidewall 106 define a hollow interior portion 107 of the body 102 having an opening 109 at a first end. Although body 102 preferably is composed of plastic and injection molded as a single piece, it is contemplated that the body 102 could comprise any commercially suitable material(s) including paper and other fibrous materials, other polycarbonates, glass, metal, and any combinations thereof.

Container 100 further includes a cap 120 which can be coupled to the body 102 to thereby cover the opening 109 of the hollow interior portion 107 of the body 102. Although cap 120 preferably is also composed of plastic and injection molded as a single piece, it is contemplated that the cap could comprise any commercially suitable material(s) including paper and other fibrous materials, other polycarbonates, glass, metal, and any combinations thereof.

As shown in FIG. 1, cap 120 can include a set of lugs 122 or other projections, which are preferably disposed on an inside or interior surface of the cap 120. Each of the lugs 122 is configured to be received within a notch 130 of a latch 131 formed on an outside surface of the sidewall 106, such that the lugs 122 each engages a notch 130.

As shown in FIGS. 1-2, each of the latches 131 comprises a first sidewall 133 adjacent to the notch 130, which preferably defines at least a portion of the notch 130. Each of the notches 130 preferably also comprises a second sidewall 135 disposed on an opposite side of the notch 130. The latch 131 may include a tapered surface on an opposing side of the second sidewall 135 that faces away from the first sidewall 133, as shown in FIG. 1. In some embodiments, the tapered surface comprises a portion of the second sidewall 135. The first and second sidewalls thereby act to keep the lug 122 seated within the notch 130 until a force is applied to the container that moves the lug 122 past one of the first and second sidewalls 133, 135, and permits the cap 120 to be rotated within respect to the body 102.

To secure the cap 120 to the body 102, each of the lugs 122 or other projections is passed by at least a portion of the latch 131 via space 141 disposed between adjacent latches 131. Once in this position, the cap 120 is rotated relative to the body 102, causing movement of the lugs 122 or other projections with respect to the notches 130. In this manner, the lugs 122 or other projections move until the lugs 122 or other projections are each disposed over or at a notch 130.

As the cap 120 is rotated with respect to the body 102, each lug 122 or other projection passes over the second sidewall 135 and the rotation continues until lug 122 or other projection is disposed at notch 130. The interaction between lug 122 or other projection and the first and second sidewalls 133, 135 of the latch 131 further inhibits rotation of the cap 120 with respect to the body 102 once the lug 122 or other projection is seated within the notch 130. In such position, a force must be applied to the cap 120 or body 102 to remove the cap 120 from the body 102.

As shown in FIGS. 1-2, an upper portion of the sidewall 106 preferably comprises a plurality of cutouts or apertures 146. While FIGS. 1-2 illustrates the cutouts 146 having a spiral-like shape that wraps about a portion of the sidewall 106, it is contemplated that the cutouts 146 could comprise other commercially-suitable shapes including, for example, a semi-circular shape, an ovular or semi-ovular shape, a rounded-triangular shape, and a diamond-like shape.

The cutouts 146 can each have a first end 147 that is positioned at a same first height of the sidewall 106 as the other cutouts 146, with each having an opposing second end 149 that is positioned at a same second height of the sidewall 106 that is different from the first height. It is contemplated that the cutouts 146 can be evenly spaced from one another about the sidewall 106. Due to the curved nature of each cutout 146, it is contemplated that each cutout begins above an adjacent, neighboring cutout, and ends beneath a different adjacent, neighboring cutout in the opposite direction.

Advantageously, the cutouts 146 form an elastic compression region or living spring that preferably causes a temporary change in a shape or dimension of one or more of the cutouts, such that potential energy is stored in the compression region. This potential energy can then be released as the force is removed from the cutouts 146. The amount of potential energy stored will depend on the spring constant of the compression region (e.g., thickness of wall, size and number of cutouts, material forming wall, etc.), and the applied force.

The cutouts 146 are preferably formed during formation of the body 102, and advantageously eliminate the need for a separate layer of foam or other material that can be compressed and expanded when a force is no longer applied. Instead, the compression region can be compressed when a force is applied, such that the cutouts 146 change from their initial configuration to a compressed configuration where the potential energy is stored while the force is applied.

Applying force to the compression region and cutouts 146 permits lugs 122 of cap 120 to move downwardly within spaces 141. Once the lugs 122 have moved a certain distance within the spaces 141, the cap 120 can be rotated with respect to the body 102, causing the lugs 122 to be placed at the notches 130. When the force is released, the release of potential energy (as the cutouts return to their initial configuration) causes the lugs 122 to be seated and remain within the notches 130. In this position, the first and second sidewalls 133, 135 of each latch 131 prevent side movement of the lug 122.

To disengage the cap 120 from the body 102, the opposite must occur. First, a force must be applied to the cap 120 or body 102 to cause the apertures to change from their initial configuration to a compressed configuration due to the interaction of the sidewall 106 with the cap 102. This in turn causes the lugs 122 to be unseated from the notches 130, such that the cap 120 can be rotated with respect to the body 102 and the lugs 122 are removed from the latches 131. Once removed, the lugs 122 can be passed through spaces 141 such that the cap 120 can be lifted from the body 102.

In some embodiments, it is contemplated that the compression region including the cutouts 146 could require an eight pound force or more to change the cutouts to the compressed configuration such that the lugs 122 are unseated from the notches 130. Of course, the specific force required can be varied to meet relevant laws and regulations and will depend on the material of the wall, and the specific configuration and number of cutouts, for example. The amount of force chosen is preferably sufficient to prevent removal of the cap 120 from the body 102 by a small child.

In some embodiments, it is contemplated that both the body and cap can comprise a fully biodegradable material, such as a paper or fibrous composition.

Figure 3:
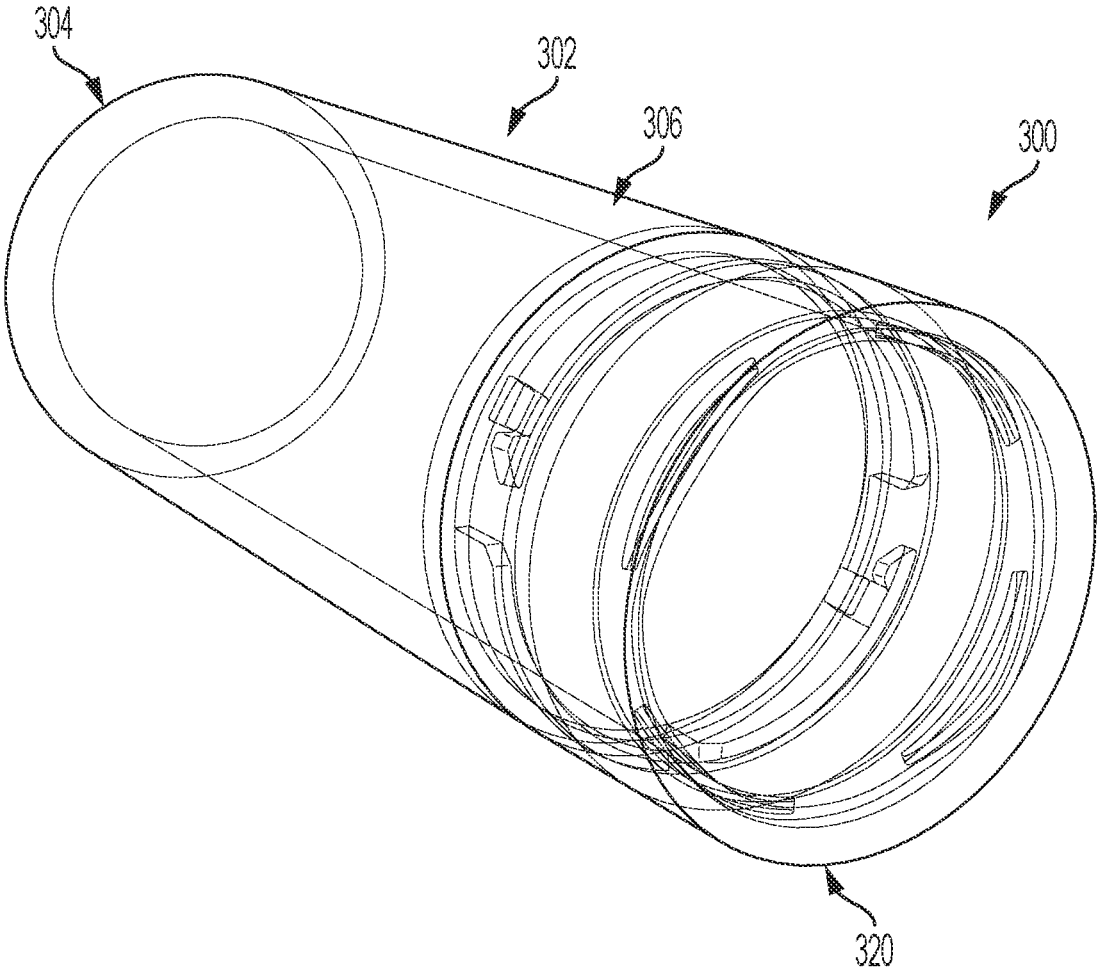
FIG. 3 illustrates a top, perspective view of another embodiment of a container with a cap positioned on the container.
Figure 4:
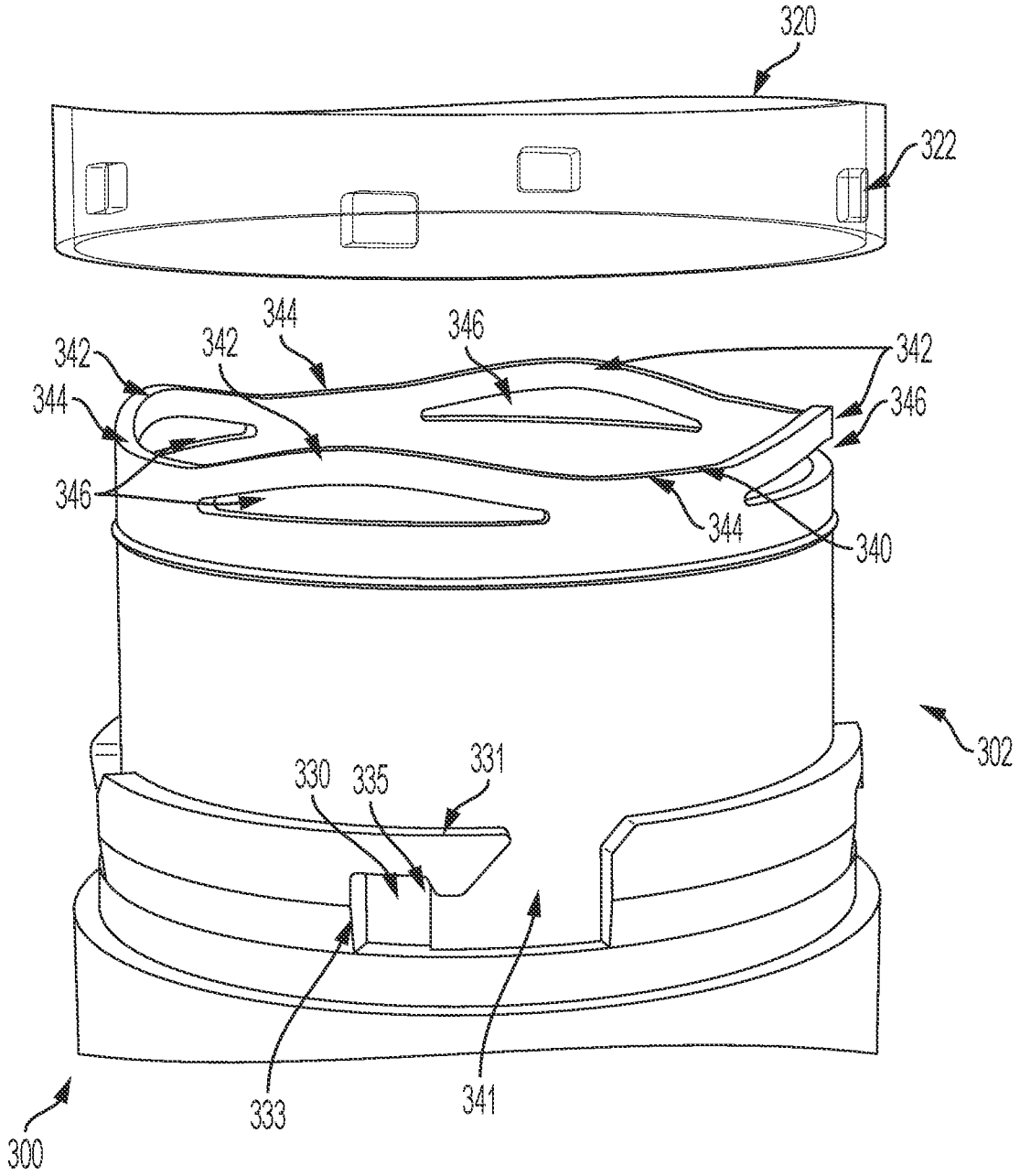
FIG. 4 illustrates an enlarged, exploded view of the container of FIG. 3.

FIGS. 3-4 illustrate one embodiment of a container 300 comprising a body 302 having a base 304 with at least one sidewall 306 extending from the base 304, such that the base 304 and the at least one sidewall 306 define a hollow interior portion of the body 302. Although body 302 preferably is composed of plastic and is injection molded, it is contemplated that the body 302 could comprise any commercially suitable material(s) including paper and other fibrous materials, other polycarbonates, glass, metal, and any combinations thereof.

Container 300 further comprises a cap 320 which can be coupled to the body 302 to thereby cover the opening of the hollow interior portion of the body 302. Although cap 320 preferably is also composed of plastic and is injection molded, it is contemplated that the cap could comprise any commercially suitable material(s) including paper and other fibrous materials, other polycarbonates, glass, metal, and any combinations thereof.

As shown in FIGS. 3-4, cap 320 can include a set of lugs 322 or other projections, which are preferably disposed on an inside surface of the cap 320. Each of the lugs 322 or other projections is configured to be received within a notch 330 formed in a latch 331 on an outside surface of the sidewall 306, such that the lugs 322 or other projections each engages a notch 330 in a "bayonet" style lock.

Each of the latches 331 comprises a generally "L"-shape, with a vertical portion defining a space 341 that extends generally vertical with respect to the body 302, and a horizontal portion extending generally horizontal and at least partially beneath notch 330. Each notch 330 is preferably defined by first and second opposing sidewalls 333, 335, with the second sidewall 335 forming a bump or projection that extends downwardly into the horizontal portion.

To secure the cap 320 to the body 302, each of the lugs 322 or other projections is first inserted into the vertical portion of the space 341. Once inserted, the cap 320 or body 302 is rotated relative to the other, such that the lug 322 or other projection is rotated relative to the body 302. In FIG. 4, the lugs 322 or other projections would move to the left during rotation. In this manner, the lug 322 or other projection then travels along the horizontal portion (away from the vertical portion) until it reaches or is over the notch 330.

As the cap 320 is rotated with respect to the body 302, the lug 322 or other projection passes by the bump or projection formed by the second sidewall 335. The rotation continues until lug 322 or other projection is disposed at notch 330.

The interaction between lug 322 or other projection and the first and second sidewalls 333, 335 limits side-to-side movement of the lug 322 or other projection, thereby requiring that a force be applied to the cap 320 or body 302 to remove the cap 320 from the body 302.

Thus, to secure the cap 320 to the body 302, the lugs 322 or other projections should be each inserted into a space 341 and then rotated with respect to the body 302 until each lug 322 or other projection is at a notch 330. This is accomplished, for example, by applying a downward force to the cap 320 against the body 302, which thereby causes lugs 322 or other projections to move downwardly within space 341. The cap 320 is then rotated relative to the body 302 to align the lugs 322 or other projections with the notches 330.

A top surface of the sidewall 306 of body 302 preferably comprises an elastic living spring 340 comprising a non-planar surface having (i) a set of peaks (raised portions) 342 that are preferably elastic, and (ii) a set of valleys 344 each disposed between adjacent peaks 342. In some embodiments, the top surface could be sinusoidal. It is especially preferred that the living spring 340 comprises one or more cutouts or apertures 346 disposed beneath one or more of the peaks 342. In such embodiments, the raised portion 342 disposed over the cutout or aperture 346 connects adjacent valleys 344.

As shown in FIG. 4, the apertures or cutouts 346 preferably have a semi-circular shape with a length that is at least two times greater than a height of the aperture 346. Alternatively, it is contemplated that the cutouts or apertures 346 could have an ovular shape, semi-ovular shape, diamond-shape (see FIG. 5), or rounded-triangular shape, for example.

Advantageously, the living spring 340 eliminates the need for a separate layer of foam or other material that can be compressed and then expand when a force is no longer applied. Instead, the raised portion 342 of the living spring 340 can be compressed downwardly (i.e. into the aperture 346) from its initial configuration shown in FIG. 4 to a compressed configuration when a force is applied to the raised portion 342, such that an area of the cutout 346 is reduced while the force is applied.

Compression of the living spring 340 stores potential energy within the living spring, and permits the lug 322 or other projection to move within space 341. When the lug 322 or other projection is rotated and at a notch 330, the force applied to the cap 320 can be removed, which releases the potential energy in the living spring and causes the raised portion 342 to return to its initial configuration. This change in configuration results in the cap 320 being raised from the body 302 and in turn causes the lug 322 or other projection to move upwardly with respect to body 302, such that each of the lugs 322 or other projections is seated within one of the notches 330. The sidewalls 333, 335 limit side-to-side movement of the lugs 322 or other projections and thereby limits rotation of the cap 320 unless the cap 320 is first pushed against the body 302, such that the lug 322 or other projection can move downwardly and past the sidewalls 333, 335.

To disengage the cap 320 from the body 302, the opposite must occur. First, a force is applied to the cap 320 to compress the living spring 340 as discussed above and allow the lugs 322 or other projections to unseat from the notches 330. Then, the cap 320 is rotated with respect to the body 302 and released.

It is contemplated that the living spring 340 could require an eight pound force or more to fully compress, although the specific force required may vary depending on the specific configuration of the living spring 340. The amount of force chosen is preferably sufficient to prevent removal of the cap 320 from the body 302 by a small child.

In some contemplated embodiments, both the body and cap can comprise a fully biodegradable material, such as a paper or fibrous composition.

Figure 5:
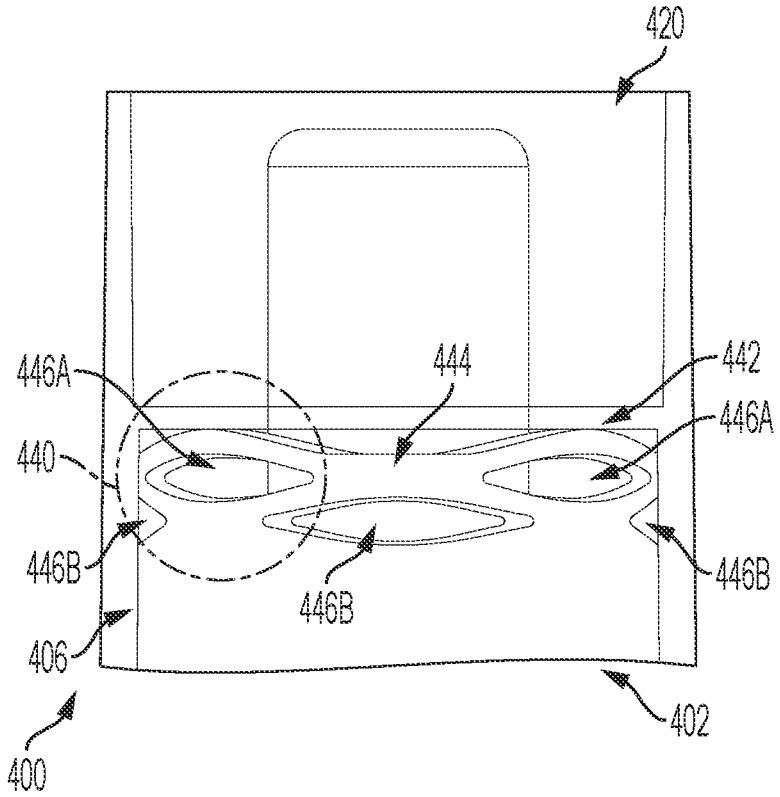
FIG. 5 illustrates a wireframe view of the container of FIG. 3.
Figure 6:
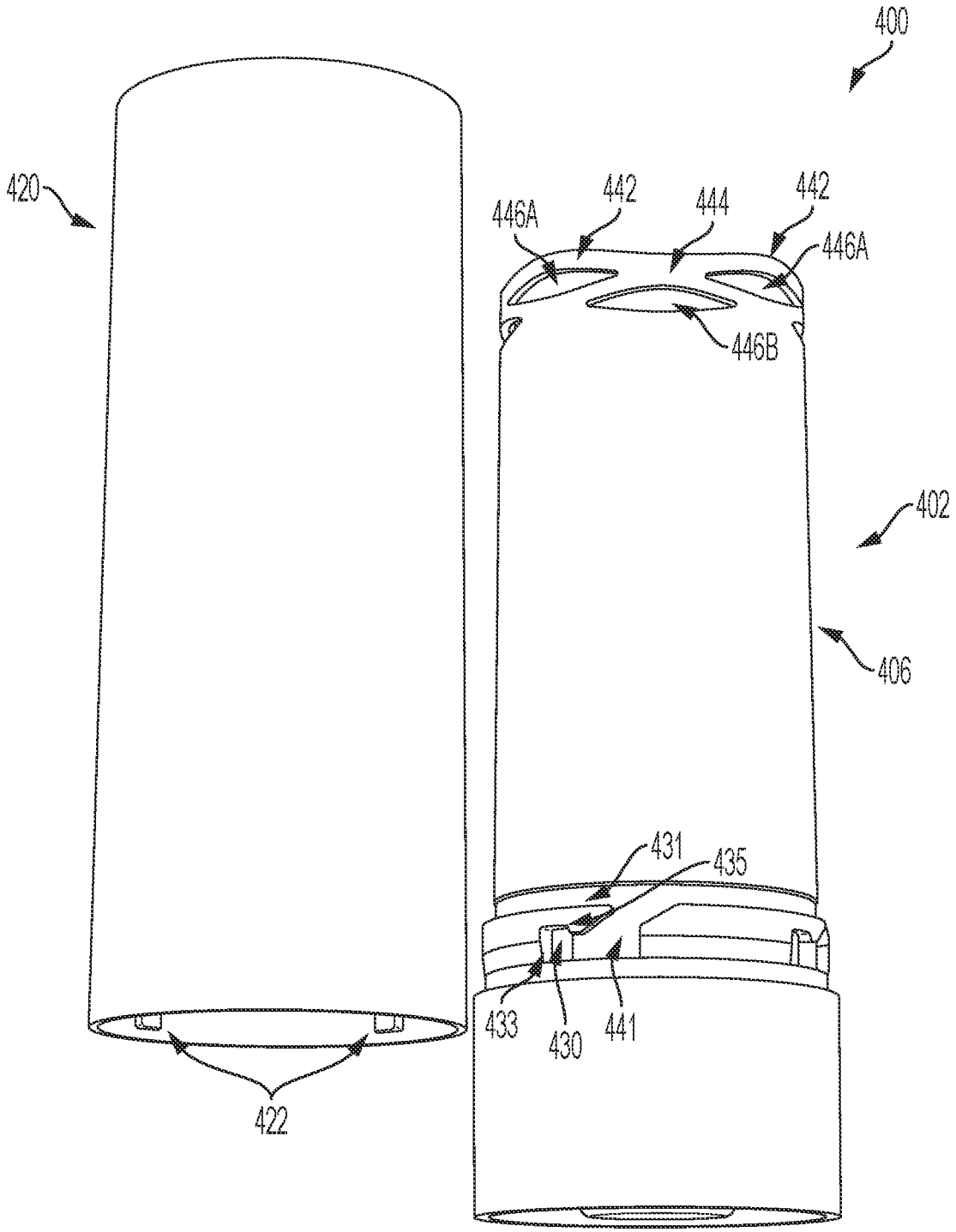
FIG. 6 illustrates a side view of yet another embodiment of a container.

FIGS. 5-6 illustrate another embodiment of a container 400 having a child-resistant closure. Similar to the containers discussed above, container 400 comprises a body 402 having a base with at least one sidewall 406 extending from the base, such that the base and the at least one sidewall 406 define a hollow interior portion of the body 402 that includes an opening at one end. Container 400 can further include a cap 420 that is configured to engage with the body 402 to thereby cover the opening.

An upper portion of the sidewall 406 preferably comprises a compression region 440 at the upper portion of the sidewall 406. Unlike the compression region or living spring shown in FIG. 4, the compression region 440 of body 402 comprises a first set of cutouts 446A and a second set of cutouts or apertures 446B, such that the apertures 446A and apertures 446B are staggered from one another, with the horizontal midpoint of an aperture 446B being disposed at a valley 444 disposed between two adjacent apertures 446A. As shown, each of the apertures 446A, 446B can comprise a diamond-shape.

The manner of securing and removing the cap 420 from the body 402 is the same as described above with respect to container 300. With respect to the remaining numerals in FIGS. 5-6, the same considerations for like components with like numerals of FIG. 4 apply.

Figure 7:
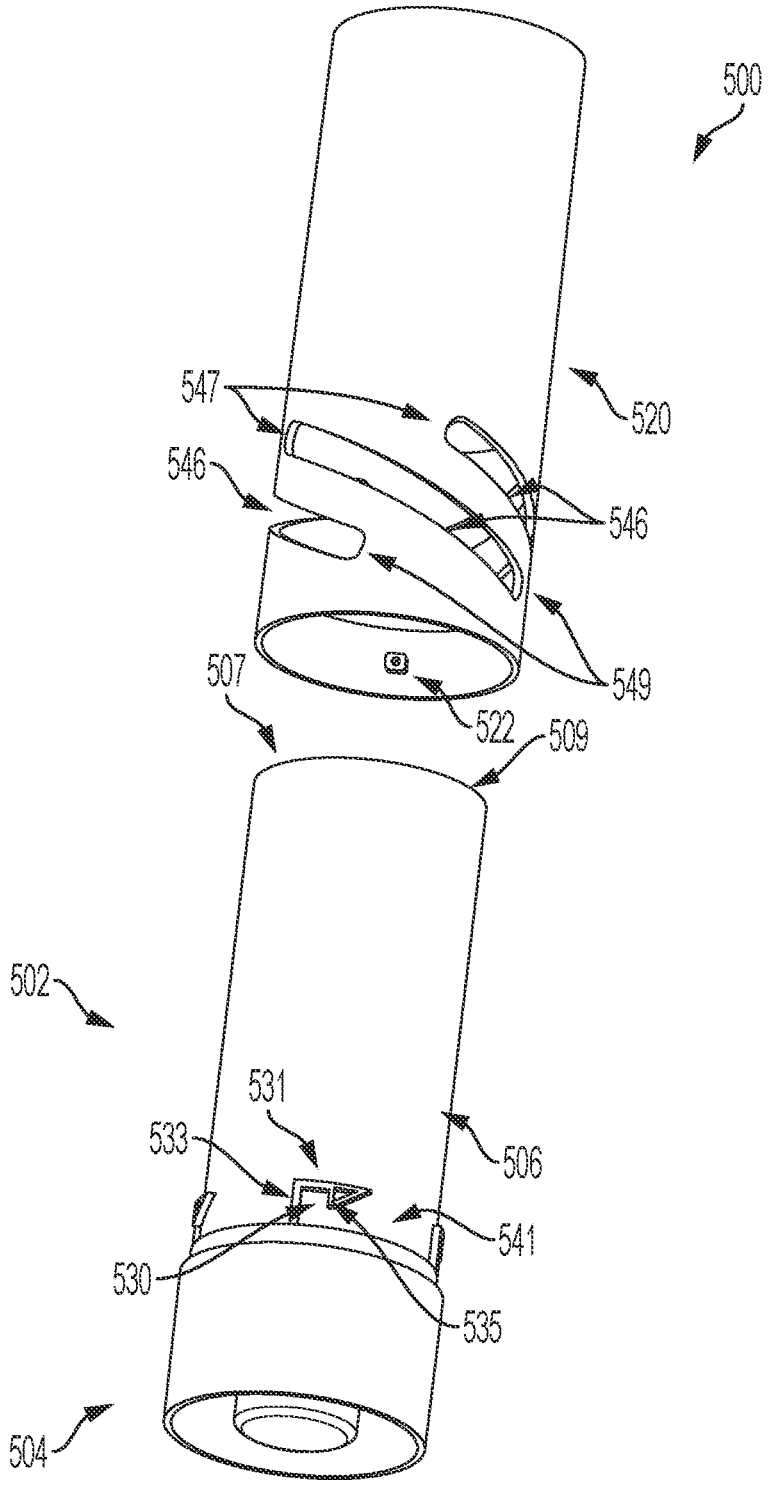
FIG. 7 illustrates a side view of yet another embodiment of a container having a cap.

FIG. 7 illustrates another embodiment of a container 500 comprising a body 502 having a base 504 with at least one sidewall 506 extending from the base 504, such that a portion of the base 504 and the at least one sidewall 506 define a hollow interior portion 507 of the body 502 having an opening 509 at a first end. Although body 502 preferably is composed of plastic and injection molded as a single piece, it is contemplated that the body 502 could comprise any commercially suitable material(s) including paper and other fibrous materials, other polycarbonates, glass, metal, and any combinations thereof.

Container 500 further includes a cap 520 which can be coupled to the body 502 to thereby cover the opening 509 of the hollow interior portion 507 of the body 502. Although cap 520 preferably is also composed of plastic and injection molded as a single piece, it is contemplated that the cap could comprise any commercially suitable material(s) including paper and other fibrous materials, other polycarbonates, glass, metal, and any combinations thereof.

Cap 520 can include a set of lugs 522 or other projections, which are preferably disposed on an inside or interior surface of the cap 520. Each of the lugs 522 is configured to be received within a notch 530 of a latch 531 formed on an outside surface of the sidewall 506, such that the lugs 522 each engages a notch 530. Alternatively, it is contemplated that the cap 520 can include the latches 531 disposed on an inner surface of the cap 520, and the sidewall 506 can include the lugs 522 disposed on the outer surface of the sidewall 506. In still other alternative embodiments, it is contemplated that other commercially suitable latches could be used to secure the cap 520 to the body 502, although those having a push and turn functionality are most preferred.

Each of the latches 531 comprises a first sidewall 533 adjacent to the notch 530, which preferably defines at least a portion of the notch 530. Each of the notches 530 preferably also comprises a second sidewall 535 disposed on an opposite side of the notch 530. The latch 531 may include a tapered surface on an opposing side of the second sidewall 535 that faces away from the first sidewall 533. In some embodiments, the tapered surface comprises a portion of the second sidewall 535. The first and second sidewalls thereby act to keep the lug 522 seated within the notch 530 until a force is applied to the container that moves the lug 522 past one of the first and second sidewalls 533, 535, and permits the cap 520 to be rotated within respect to the body 502.

To secure the cap 520 to the body 502, each of the lugs 522 or other projections is passed by at least a portion of the latch 531 via space 541 disposed between adjacent latches 531. Once in this position, the cap 520 is rotated relative to the body 502, causing movement of the lugs 522 or other projections with respect to the notches 530. In this manner, the lugs 522 or other projections move until the lugs 522 or other projections are each disposed over or at a notch 530.

As the cap 520 is rotated with respect to the body 502, each lug 522 or other projection passes over the second sidewall 535 and the rotation continues until lug 522 or other projection is disposed at notch 530. The interaction between lug 522 or other projection and the first and second sidewalls 533, 535 of the latch 531 further inhibits rotation of the cap 520 with respect to the body 502 once the lug 522 or other projection is seated within the notch 530. In such position, a force must be applied to the cap 520 or body 502 to remove the cap 520 from the body 502.

As shown in FIG. 7, an end portion of the cap 520 preferably comprises a plurality of cutouts or apertures 546 that collectively define a compression region. While FIG. 7 illustrates the cutouts 546 having a spiral-like shape that wraps about a portion of the cap 520, it is contemplated that the cutouts 546 could comprise other commercially-suitable shapes including, for example, a semi-circular shape, an ovular or semi-ovular shape, a rounded-triangular shape, and a diamond-like shape.

The cutouts 546 can each have a first end 547 that is positioned at a same first height of the sidewall 506 as the other cutouts 546, with each having an opposing second end 549 that is positioned at a same second height of the sidewall 506 that is different from the first height. Further discussion about the cutouts 546 can be found above with respect to FIGS. 1-2.

The cutouts 546 are preferably formed during formation of the cap 520, and advantageously eliminate the need for a separate layer of foam or other material that can be compressed and expanded when a force is no longer applied. Instead, the compression region can be compressed when a force is applied, such that the cutouts 546 change from their initial configuration to a compressed configuration where the potential energy is stored while the force is applied.

Applying force to the compression region and cutouts 546 permits lugs 522 of cap 520 to move downwardly within spaces 541. Once the lugs 522 have moved a certain distance within the spaces 541, the cap 520 can be rotated with respect to the body 502, causing the lugs 522 to be placed at the notches 530. When the force is released, the release of potential energy (as the cutouts return to their initial configuration) causes the lugs 522 to be seated and remain within the notches 530. In this position, the first and second sidewalls 533, 535 of each latch 531 prevent side movement of the lug 522.

To disengage the cap 520 from the body 502, the opposite must occur. First, a force must be applied to the cap 520 or body 502 to cause the apertures to change from their initial configuration to a compressed configuration due to the interaction of the sidewall 506 with the cap 502. This in turn causes the lugs 522 to be unseated from the notches 530, such that the cap 520 can be rotated with respect to the body 502 and the lugs 522 are removed from the latches 531. Once removed, the lugs 522 can be passed through spaces 541 such that the cap 520 can be lifted from the body 502.

With respect to any remaining numerals in FIG. 7, the same considerations for like components with like numerals of FIG. 1 apply.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A container, comprising:

a body having a base with at least one wall extending from the base, such that the base and at least one wall define a hollow interior portion of the body that includes a first opening;

a cap configured to engage with the body to thereby cover the first opening; and wherein a first end of the cap comprises a set of apertures that collectively define an elastic compression region, each aperture having a first dimension having a first value and a second dimension having a second value, the first value being larger than the second value;

wherein each of the apertures comprises a first end and a second end; and wherein the set of apertures is configured such that (i) when an axial force is applied to the cap in a direction toward the body, the apertures compress and the second value decreases, and (ii) when the axial force is removed, the second value increases.

2. The container of claim 1, wherein the first end of each of the set of apertures is at a same height as the first end of the others of the set of apertures.

3. The container of claim 1, wherein the second end of each of the set of apertures is at a same height as the second end of the others of the set of apertures.

4. The container of claim 1, wherein the set of apertures comprises a plurality of curved cutouts that each wraps about a portion of the cap.

5. The container of claim 4, wherein the set of apertures comprises first, second, and third cutouts, and where a first end of the second cutout is above the first cutout, and wherein a second end of the second cutout is above the third cutout.

6. The container of claim 1, wherein the cap further comprises a set of projections on an interior surface of the cap, and wherein the body further comprises a set of notches on an exterior surface, wherein each of the notches is configured to receive one of the projections of the set of projections.

7. The container of claim 1, wherein the at least one wall further comprises a set of projections on an exterior surface of the wall, and wherein the cap further comprises a set of notches on an interior surface, wherein each of the notches is configured to receive one of the projections of the set of projections.

8. The container of claim 1, wherein an upper portion of the at least one wall comprises a planar surface.

9. The container of claim 1, wherein each of the set of apertures comprises a spiral shape.

10. The container of claim 1, wherein each of the set of apertures comprises a diamond shape.

11. The container of claim 1, wherein each of the set of apertures comprises a rounded triangular shape.

12. The container of claim 1, wherein each of the set of apertures comprises a semi-circular shape.

13. The container of claim 1, wherein each aperture of the set of apertures comprises a cutout in the cap.

* * * * *